US008220543B2

(12) United States Patent
Clark et al.

(10) Patent No.: US 8,220,543 B2
(45) **Date of Patent: *Jul. 17, 2012**

(54) METHOD AND SYSTEM FOR TREATING A SUBTERRANEAN FORMATION USING DIVERSION

(75) Inventors: William Ernest Clark, Oklahoma City, OK (US); Doug Bentley, Edmond, OK (US); John Daniels, Oklahoma City, OK (US); Christopher N. Fredd, Leesburg, FL (US); Charles Miller, Houston, TX (US); John Lassek, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/045,146

(22) Filed: Mar. 10, 2011

(65) Prior Publication Data

US 2011/0186298 A1 Aug. 4, 2011

Related U.S. Application Data

(62) Division of application No. 11/751,172, filed on May 21, 2007, now Pat. No. 7,934,556.

(51) Int. Cl.
*E21B 43/14* (2006.01)
*E21B 47/10* (2012.01)

(52) U.S. Cl. ..... 166/281; 166/250.01; 166/250.17

(58) Field of Classification Search ..... 166/281, 166/308.1, 250.01, 250.17
See application file for complete search history.

(56) References Cited

U.S. PATENT DOCUMENTS

| | | | |
|---|---|---|---|
| 3,998,272 | A | 12/1976 | Maly |
| 5,258,137 | A | 11/1993 | Bonekamp et al. |
| 5,330,005 | A | 7/1994 | Card et al. |
| 5,439,055 | A | 8/1995 | Card et al. |
| 5,501,275 | A | 3/1996 | Card et al. |
| 5,551,516 | A | 9/1996 | Norman et al. |
| 5,924,295 | A | 7/1999 | Park |

(Continued)

FOREIGN PATENT DOCUMENTS

EP 0278540 8/1992

(Continued)

OTHER PUBLICATIONS

SPE 39945—Induced Stress Diversion: A Novel Approach to Fracturing Multiple Pay sands of the NBU Field, Uintah Co., Utah—TW Hewett and CJ Spence. Apr. 5-8, 1996—Presented at the 1996 SPE Rocky Mountain Regional Low-Permeability Reservoirs Symposium and Exhibition in Denver, Colorado.

(Continued)

*Primary Examiner* — William P Neuder
(74) *Attorney, Agent, or Firm* — Robin Nava; Daryl R. Wright; Myron Stout

(57) ABSTRACT

A method well treatment includes establishing fluid connectivity between a wellbore and at least one target zone for treatment within a subterranean formation, which is intersected by a wellbore. The method includes deploying coiled tubing into the wellbore and introducing a treatment composition into the wellbore. The method includes contacting a target zone within the subterranean formation with the treatment composition, introducing a diversion agent through the coiled tubing to an interval within a wellbore and repeating the introduction of the treatment, the contacting of the target zone and the introduction of the diversion agent for more than one target zone.

44 Claims, 8 Drawing Sheets

U.S. PATENT DOCUMENTS

| | | | | |
|---|---|---|---|---|
| 5,964,295 | A | 10/1999 | Brown et al. | |
| 5,979,557 | A | 11/1999 | Card et al. | |
| 6,172,011 | B1 | 1/2001 | Card et al. | |
| 6,435,277 | B1 | 8/2002 | Qu et al. | |
| 6,599,863 | B1 | 7/2003 | Palmer et al. | |
| 6,667,280 | B2 | 12/2003 | Chang et al. | |
| 6,703,352 | B2 | 3/2004 | Dahayanake et al. | |
| 6,837,309 | B2 | 1/2005 | Boney et al. | |
| 6,938,693 | B2 | 9/2005 | Boney et al. | |
| 7,004,255 | B2 | 2/2006 | Boney | |
| 7,055,604 | B2 | 6/2006 | Jee et al. | |
| 7,119,050 | B2 | 10/2006 | Chang et al. | |
| 7,166,560 | B2 | 1/2007 | Still et al. | |
| 7,275,596 | B2 | 10/2007 | Willberg et al. | |
| 7,318,475 | B2 | 1/2008 | Cavazzoli et al. | |
| 7,341,107 | B2 | 3/2008 | Fu et al. | |
| 7,350,572 | B2 | 4/2008 | Fredd et al. | |
| 7,677,317 | B2 * | 3/2010 | Wilson | 166/308.2 |
| 7,934,556 | B2 * | 5/2011 | Clark et al. | 166/281 |
| 2002/0007949 | A1 | 1/2002 | Tolman et al. | |
| 2003/0060374 | A1 | 3/2003 | Cooke, Jr. | |
| 2004/0152604 | A1 | 8/2004 | Qu et al. | |
| 2004/0261993 | A1 | 12/2004 | Nguyen | |
| 2005/0113263 | A1 | 5/2005 | Brown et al. | |
| 2005/0230107 | A1 | 10/2005 | McDaniel et al. | |
| 2006/0169453 | A1 | 8/2006 | Savery et al. | |
| 2006/0175059 | A1 | 8/2006 | Sinclair et al. | |
| 2007/0272407 | A1 | 11/2007 | Lehman et al. | |

FOREIGN PATENT DOCUMENTS

| | | |
|---|---|---|
| WO | 0206629 | 1/2002 |
| WO | 2004018840 | 3/2004 |

OTHER PUBLICATIONS

SPE 37489—Understanding Proppant Closure Stress. SK Schubarth, SL Cobb, RG Jeffrey. Presented at the 1997 SPE Production Operations Symposium, held in Oklahoma City, OK Mar. 9-11, 1997.

* cited by examiner

METHOD AND SYSTEM FOR TREATING A SUBTERRANEAN FORMATION USING DIVERSION

This application claims priority as a divisional application of U.S. patent application Ser. No. 11/751,172, filed May 21, 2007, entitled "Method and System for Treating a Subterranean Formation Using Diversion," which is hereby incorporated by reference in its entirety. This application claims the benefit under 35 U.S.C. §119(e) to U.S. Provisional Application Ser. No. 60/806,058, entitled, "METHOD AND SYSTEM FOR TREATING A SUBTERRANEAN FORMATION USING DIVERSION," which was filed on Jun. 28, 2006, and is hereby incorporated by reference in its entirety.

BACKGROUND

This invention relates generally to a method and system for treating a subterranean formation using diversion.

Wellbore treatment methods often are used to increase hydrocarbon production by using a treatment fluid to affect a subterranean formation in a manner that increases oil or gas flow from the formation to the wellbore for removal to the surface. Hydraulic fracturing and chemical stimulation are common treatment methods used in a wellbore. Hydraulic fracturing involves injecting fluids into a subterranean formation at such pressures sufficient to form fractures in the formation, the fractures increasing flow from the formation to the wellbore. In chemical stimulation, flow capacity is improved by using chemicals to alter formation properties, such as increasing effective permeability by dissolving materials in or etching the subterranean formation. A wellbore may be an open hole or a cased hole where a metal pipe (casing) is placed into the drilled hole and often cemented in place. In an open hole, a slotted liner or screen may be installed. In a cased wellbore, the casing (and cement if present) typically is perforated in specified locations to allow hydrocarbon flow into the wellbore or to permit treatment fluids to flow from the wellbore to the formation.

To access hydrocarbon effectively and efficiently, it is desirable to direct the treatment fluid to target zones of interest in a subterranean formation. There may be target zones of interest within various subterranean formations or multiple layers within a particular formation that are preferred for treatment. In such situations, it is preferred to treat the target zones or multiple layers without inefficiently treating zones or layers that are not of interest. In general, treatment fluid flows along the path of least resistance. For example, in a large formation having multiple zones, a treatment fluid would tend to dissipate in the portions of the formation that have the lowest pressure gradient or portions of the formation that require the least force to initiate a fracture. Similarly in horizontal wells, and particularly those horizontal wells having long laterals, the treatment fluid dissipates in the portions of the formation requiring lower forces to initiate a fracture (often near the heel of the lateral section) and less treatment fluid is provided to other portions of the lateral. Also, it is desirable to avoid stimulating undesirable zones, such as water-bearing or non-hydrocarbon bearing zones. Thus it is helpful to use methods to divert the treatment fluid to target zones of interest or away from undesirable zones.

Diversion methods are known to facilitate treatment of a specific interval or intervals. Ball sealers are mechanical devices that frequently are used to seal perforations in some zones thereby diverting treatment fluids to other perforations. In theory, use of ball sealers to seal perforations permits treatment to proceed zone by zone depending on relative breakdown pressures or permeability. But frequently ball sealers prematurely seat on one or more of the open perforations, resulting in two or more zones being treated simultaneously. Likewise, when perforated zones are in close proximity, ball sealers have been found to be ineffective. In addition, ball sealers are useful only when the casing is cemented in place. Without cement between the casing and the borehole wall, the treatment fluid can flow through a perforation without a ball sealer and travel in the annulus behind the casing to any formation. Ball sealers have limited use in horizontal wells owing to the effects of formation pressure, pump pressure, and gravity in horizontal sections, as well as that possibility that laterals in horizontal wells may not be cemented in place.

Changes in pumping pressures are used to detect whether ball sealer have set in perforations; this inherently assuming that the correct number of ball sealers were deployed to seal all the relevant perforations and that the balls are placed in the correct location for diverting the treatment fluids to desired zones. Other mechanical devices known to be used for used for diversion include bridge plugs, packers, down-hole valves, sliding sleeves, and baffle/plug combinations; and particulate placement. As a group, use of such mechanical devices for diversion tends to be time consuming and expensive which can make them operationally unattractive, particularly in situations where there are many target zones of interest. Chemically formulated fluid systems are known for use in diversion methods and include viscous fluids, gels, foams, or other fluids. Many of the known chemically formulated diversion agents are permanent (not reversible) in nature and some may damage the formation. In addition, some chemical methods may lack the physical structure and durability to effectively divert fluids pumped at high pressure or they may undesirably affect formation properties. The term diversion agent herein refers to mechanical devices, chemical fluid systems, combinations thereof, and methods of use for blocking flow into or out of a particular zone or a given set of perforations.

In operation, it is preferred that the treatment fluid enters the subterranean formation only at the target zones of interest. It is more preferred that the treatment fluid treatment enters the subterranean formation on a stage-by-stage basis. But known disadvantages to existing diversion methods do not permit a level of confidence or certainty as to where the diversion agent is placed, whether single treatment stages are being accomplished, whether target zones of interest are treated, as well as the order of treatment of the target zones.

What is needed is a reliable method of selectively and efficiently treating target zones in a subterranean formation using a diversion agent and monitoring during the treatment.

SUMMARY

In an embodiment of the invention, a method well treatment includes establishing fluid connectivity between a wellbore and at least one target zone for treatment within a subterranean formation, which is intersected by a wellbore. The method includes deploying coiled tubing and introducing a treatment composition into the wellbore. The method further includes contacting a target zone within the subterranean formation with the treatment composition, introducing a diversion agent through the coiled tubing to an interval within the wellbore and repeating the introduction of the treatment, the contacting of the target zone with the treatment composition and the introduction of the diversion agent for more than one target zone.

In another embodiment of the invention, a method of treating more than one target zone of interest in a subterranean formation includes pumping a treatment composition to contact at least one target zone of interest with the treatment composition; monitoring the pumping of the treatment composition; and measuring a parameter indicative of the treatment. The method includes pumping a diversion agent to a desired diversion interval in the wellbore. The pumping of the diversion agent is monitored, and a parameter that is indicative of diversion is measured. The method includes pumping a treatment composition to contact at least one other target zone of the well. At least one of the pumping of the treatment composition and the pumping of the diversion agent is modified based on at least one of the measured parameters.

In yet another embodiment of the invention, a technique usable with a well includes introducing a fluid into an interval of the well. The fluid contains a fluid loss control agent. The technique also includes, in the presence of the fluid, jetting the interval with an abrasive slurry.

Advantages and other features of the invention will become apparent from the following drawing, description and claims.

DETAILED DESCRIPTION

The present invention will be described in connection with its various embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

Figure 1:
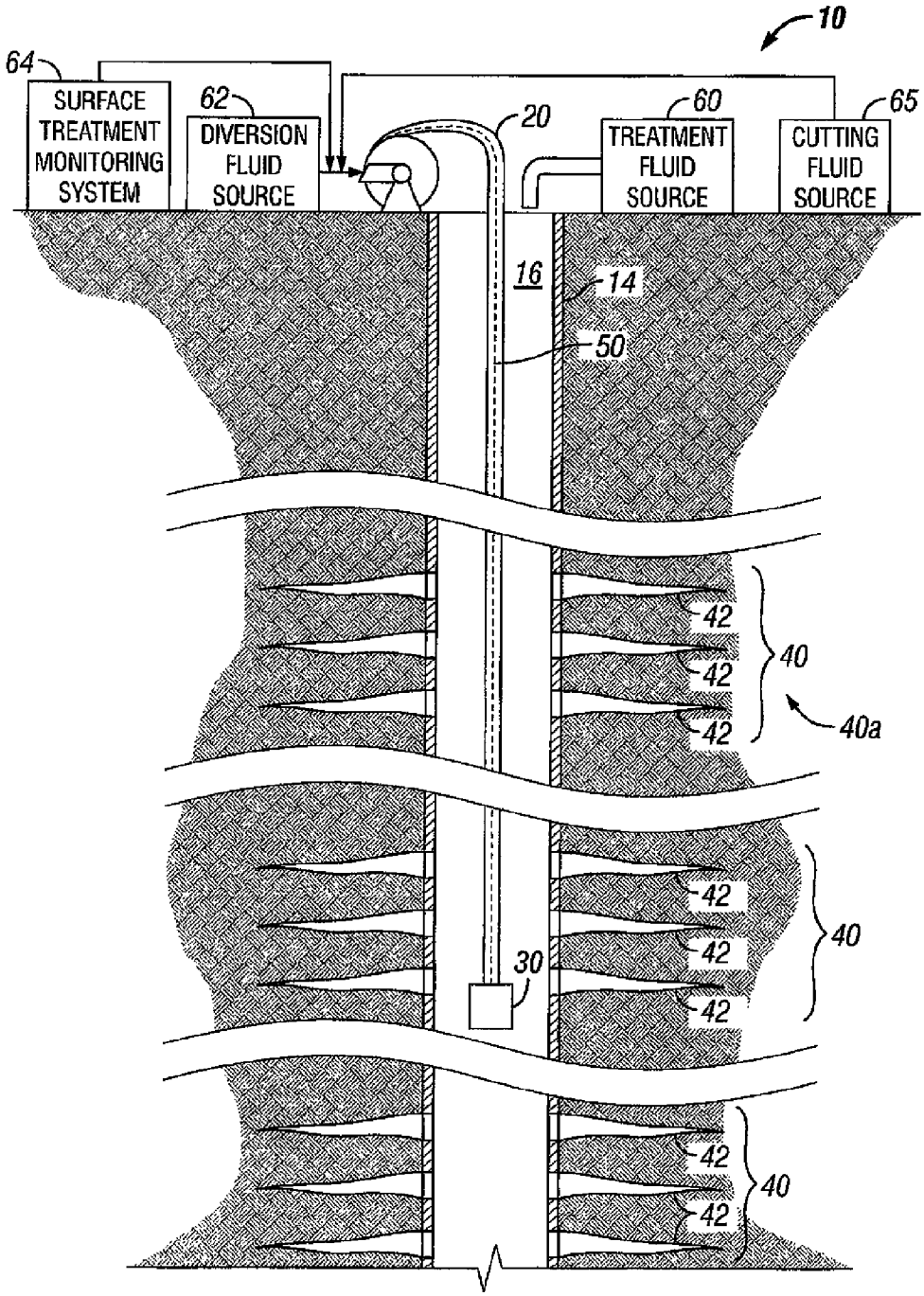
FIGS. 1, 5 and 6 are schematic diagrams of wells according to embodiments of the invention.

Referring to FIG. 1, an embodiment of a well 10 in accordance with the invention includes a system that allows treatment of more than one target zone of interest using the introduction of a diversion agent to direct treatment fluid to the target zones. In general, the well 10 includes a wellbore 12, which intersects one or more subterranean formations and establishes, in general, several target zones of interest, such as exemplary zones 40 that are depicted in FIG. 1. As depicted in FIG. 1, the wellbore 12 may be cased by a casing string 14, although the systems and techniques that are disclosed herein may be used with uncased wellbores in accordance with other embodiments of the invention.

As depicted in FIG. 1, in accordance with some embodiments of the invention, a coiled tubing string 20 extends downhole form the surface of the well 10 into the wellbore 12. At its lower end, the coiled tubing string 20 includes a bottom hole assembly (BHA) 30. In other embodiments of the invention, the coiled tubing string 20 may be replaced by another string, such as, by nonlimiting example, a jointed tubing string, or any structure, ready known to those of skill in the art, which capable or serving as a suitable means for transferring fluids between the surface and one or more treatment zones in the wellbore.

FIG. 1 depicts a state of the well 10 in which fluid connectivity between the wellbore 12 and the zones 40 has been established, as depicted by perforations 42, which penetrate the casing string 14 and generally extend into the surrounding formation(s) to bypass any near wellbore damage. It is noted that the perforation of the zones 40 may be performed by, for example, jetting subs, as well as other conventional perforation devices, such as tubing or wireline-conveyed shaped charge-based perforating guns, sliding sleeves, or TAP valves, for example.

For embodiments of the invention, in which jetting is used, the well 10 may include a cutting fluid source 65 (cutting fluid reservoirs, control valves, etc.), which is located at the surface of the well. The cutting fluid source 65, at the appropriate time, supplies an abrasive cutting fluid, or slurry, to the central passageway of the coiled tubing string 20 so that the slurry is radially directed by a jetting sub (contained in the BHA 30 of the coiled tubing string 20) to penetrate the casing string 14 (if the well 10 is cased) and any surrounding formations.

For purposes of introducing treatment fluid into the well 10, the well 10 may include a treatment fluid source 60 (a source that contains a treatment fluid reservoir, a pump, control valves, etc.) that is located at the surface of the well 10 and is, in general, in communication with an annulus 16 of the well 10.

The well 10 may also have a diversion fluid source 62 that is located at the surface of the well 10. During a diversion stage (discussed below), a diversion fluid, or agent, is communicated downhole through the central passageway of the coiled tubing string 20 and exits the string 20 near its lower end into a region of the well 10 to be isolated from further treatment. The diversion fluid source 62 represents, for example, a diversion fluid reservoir, pump and the appropriate control valves for purposes of delivering the diversion fluid to the central passageway of the coiled tubing string 20.

Among the other features of the well 10, as shown in FIG. 1, in accordance with some embodiments of the invention, the well 10 may include a surface treatment monitoring system 64, which is in communication with a downhole treatment monitoring system for purposes of monitoring one or more parameters of the well in connection with the communication of the diversion agent or the communication of the treatment fluid downhole so that the delivery of the treatment fluid/diversion agent may be regulated based on the monitored parameter(s), as further described below.

Figure 2:
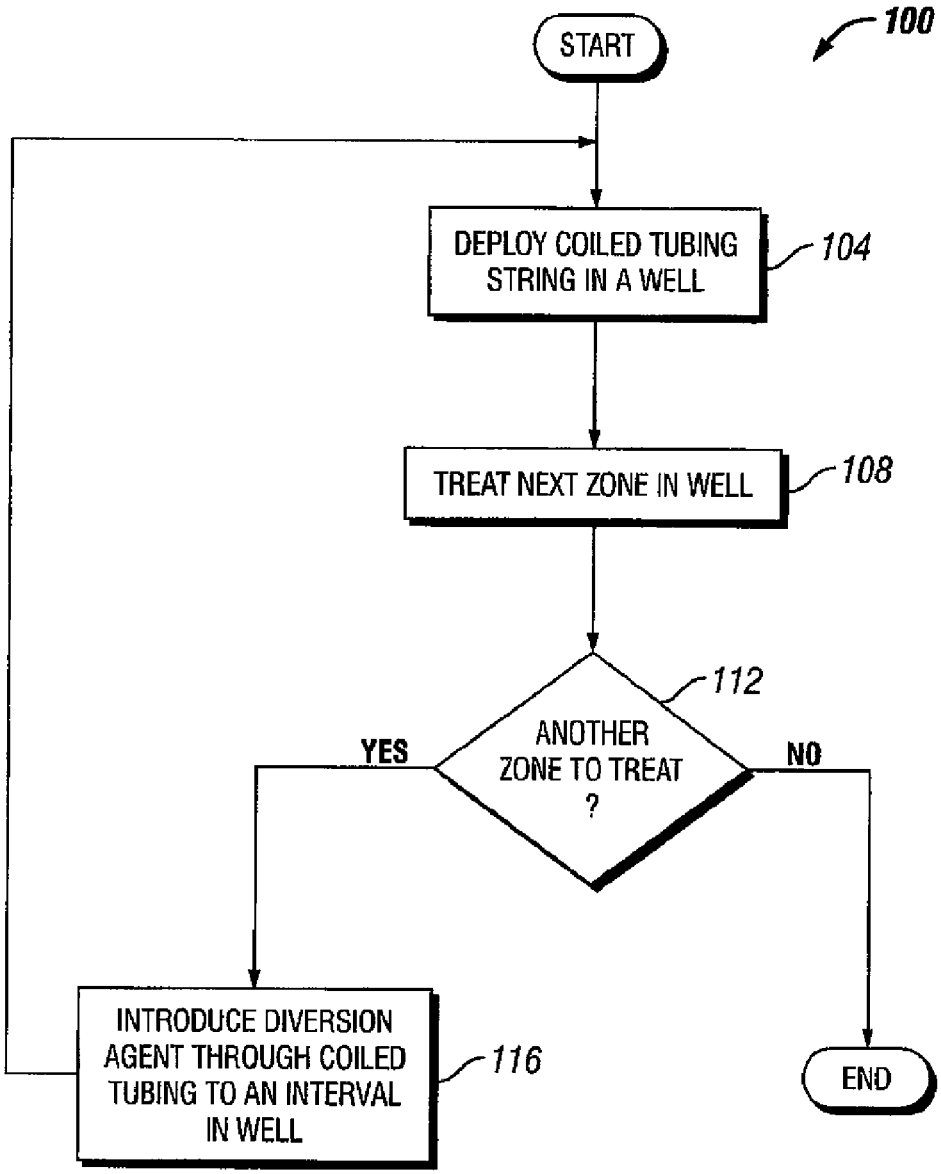
FIGS. 2, 3, 4A and 4B are flow diagrams depicting techniques to treat more than one target zone of interest according to different embodiments of the invention.

Referring to FIG. 2 in conjunction with FIG. 1, in accordance with embodiments of the invention, a technique 100 may generally be performed for purposes of treating the target zones 40. Pursuant to the technique 100, a coiled tubing string is deployed in the well, pursuant to block 104. Next, the technique 100 involves a repeated loop for purposes of treating the zones 40, one at a time. This may be applicable, for example, where a zone may include one or more clusters of perforations. This loop includes treating (block 108) the next zone 40, pursuant to block 108. If a determination is made (diamond 112) that the well 10 contains another zone 40 for treatment, then the technique 100 includes introducing a diversion agent through the coiled tubing string to an interval of the well to facilitate this treatment, pursuant to block 116.

More specifically, in accordance with some embodiments of the invention, the target intervals 40 may be treated as follows. First, in accordance with embodiments of the invention, fluid connectivity is established between the wellbore 12 and the target zones 40 for treatment. A target zone for treatment within a subterranean formation is intended to be broadly interpreted as any zone, such as a permeable layer within a stratified formation, a zone within a thick formation that is distinguished by pressure or pressure gradient characteristics more than by stratigraphic or geologic characteristics or a zone that is distinguished by the type or relative cut of fluid (e.g., oil, gas, water) in its pore spaces.

Although a vertical wellbore 12 is depicted in FIG. 1, the techniques that are disclosed herein may be employed advantageously to treat well configurations including, but not limited to, vertical wellbores, fully cased wellbores, horizontal wellbores, open-hole wellbores, wellbores including multiple lateral and wellbores which share more of these characteristics. A wellbore may have vertical, deviated, or horizontal portions or combinations thereof. The casing string 14 may be cemented in the wellbore, with the method of cementing typically involving pumping cement in the annulus between the casing and the drilled wall of the wellbore. However, it is noted that in some embodiments of the invention, the casing string 14 may not be cemented, such as for the case in which casing string 14 lines a lateral wellbore. Thus, it is appreciated that the casing string 14 may be a liner, broadly considered herein as any form of casing that does not extend to the ground surface at the top of the well or even a specific interval length along a horizontal wellbore.

The target zones 40 of interest for treatment may have differing stress gradients that may inhibit effective treatment of the zones 40, without the use of a diversion agent.

The target zones 40 may be designated in any number of ways, which can be appreciated by one skilled in the art, such as by open-hole and/or cased-hole logs. As set forth above, the target zones 40 may be perforated using conventional perforation devices for purposes of establishing fluid connectivity between the wellbore 12 and the surrounding formation(s).

For example, the perforations may be formed in all of the target zones 40 of interest for treatment in a single trip using a perforating gun that is deployed on wireline through the wellbore 12. In the event of an open-hole wellbore with natural fractures, no additional action or activity may be required to establish fluid connectivity between the wellbore 12 and the target zones 40 of interest.

In some embodiments of the invention, fluid connectivity may be established by the use of pre-perforated casing, shifting a sleeve to expose openings between the wellbore and the casing, cutting a slot or slots in the casing or any other such known method to provide an opening between the wellbore 12 and the target zones 40 for treatment. Alternative methods such as laser perforating or chemical dissolution are contemplated and are within the scope of the appended claims. It is understood that the benefits of the disclosed methods and compositions may be realized with treatments performed below, at, or above a fracturing pressure of a formation.

Referring to FIG. 1, after fluid connectivity has been established, the coiled tubing string 20 is deployed into the wellbore 12 at a desired depth using techniques as can be appreciated by those skilled in the art. In some embodiments of the invention, the acts of establishing fluid connectivity and deploying the coiled tubing string 20 into the wellbore 12 may be combined by deploying a perforating device, such as a jetting sub (part of the BHA), through which an abrasive cutting fluid, or slurry, is pumped downhole via the central passageway of the coiled tubing string 20. It is noted that the jetting sub may be used for purposes of cutting through the surrounding casing string 14 and forming perforations into the surrounding formation(s).

After the coiled tubing string 20 has been deployed in the well 10, an apparatus or system for measuring or monitoring at least one parameter that is indicative of treatment may then deployed into the wellbore 12. In this regard, the surface treatment monitoring system 64 is connected to the deployed apparatus or system for purposes of monitoring treatment as well as possibly the placement of the diversion agent into the well 10. For example, when using hydraulic fracturing for treatment, a hydraulic fracturing monitoring system, which is capable of detecting and monitoring microseisms in the subterranean formation that results from the hydraulic fracturing may be deployed.

Examples of known systems and methods for hydraulic fracturing monitoring in offset wells are discloses in U.S. Pat. No. 5,771,170, which is hereby incorporated by reference in its entirety. Alternatively in accordance with other embodiments of the invention, the apparatus or system for measuring or monitoring at least one parameter indicative of treatment may be deployed in the wellbore 12. A system and method for hydraulic fracturing monitoring using tiltmeters in a treatment well is disclosed, for example, in U.S. Pat. No. 7,028,772, which is hereby incorporated by reference in its entirety.

In some embodiments of the invention, the surface treatment monitoring system 64 may be coupled to a monitoring device that is deployed inside the coiled tubing string 20. For example, as depicted in FIG. 1, a fiber optic-based sensor 50 may be deployed in the coiled tubing string 20, as described in U.S. patent application Ser. No. 11/111,230, published as U.S. Patent Application Publication No. 2005/0236161, which is hereby incorporated by reference in its entirety.

Other measurement or monitoring apparatuses suitable for use in the well 10 include, for example, apparatuses known for use in determining borehole parameters such as bottom-hole pressure gauges or bottom-hole temperature gauges. Another example of systems and methods known for monitoring at least one parameter indicative of treatment (such as temperature or pressure) is disclosed in U.S. Pat. No. 7,055,604, which is hereby incorporated by reference in its entirety. As yet another example, the measurements which may be monitored include tension or compression acting upon a downhole device (such as coiled tubing) as an indicator of fluid flow friction. The measurements may also include downhole measurements of fluid flow rate or velocity.

After the system or apparatus for measuring or monitoring at least one parameter indicative of treatment and possibly diversion placement is deployed in the well 10, treatment of a target zone 40 of interest begins. In particular, in accordance with some embodiments of the invention, treatment of a target zone 40 of interest begins by pumping treatment fluid (via the source 60) into the annulus 16 between the coiled tubing string 20 and the casing string 14 (in the case of a cased well) or between the coiled tubing string 20 and the wellbore wall (in the case of an open hole well). Alternatively, the treatment fluid may also be pumped into the wellbore through the coiled tubing. The treatment of a target zone 40 by pumping treatment fluid is referred to herein as a treatment stage.

A treatment fluid may be any suitable treatment fluid known in the art, including, but not limited to, stimulation fluids, water, treated water, aqueous-based fluids, nitrogen, carbon dioxide, any acid (such as hydrochloric, hydrofluoric, acetic acid systems, etc), diesel, or oil-based fluids, gelled oil and water systems, solvents, surfactant systems, and fluids transporting solids for placement adjacent to or into a target zone, for example. A treatment fluid may include components such as scale inhibitors in addition to or separately from a stimulation fluid. In some embodiments of the invention, the treatment fluid may include proppant, such as sand, for placement into hydraulic fractures in the target zone by pumping the treatment fluid at high enough pressures to initiate fractures. Equipment (tanks, pumps, blenders, etc.) and other details for performing treatment stages are known in the art and are not described for simplicity.

A treatment model appropriate for matrix and/or fracture pressure simulation may be performed to model a planned well treatment in conjunction with the disclosed method. Such models are well known in the art with many models being useful for predicting treatment bottom-hole pressures. The data generated from such a model may be compared to bottom hole treating pressures (BHTP) during previously described well treatment phase of the disclosed method.

During the treatment, at least one parameter of the well, which is indicative of the treatment is monitored. Examples of methods for monitoring a parameter indicative of stimulation are disclosed in U.S. patent application Ser. No. 11/135,314, published as U.S. Patent Application Publication No. 2005/0263281, which is hereby incorporated by reference in its entirety. Microseisms generated by hydraulic fracturing and other types of treatment may be monitored using hydraulic fracture monitoring (HFM), for example.

The treatment operation may be modified based on the monitored parameter(s) in accordance with some embodiments of the invention. For example, a parameter, such as microseismic activity may be monitored during hydraulic fracturing to determine or confirm the location and geometric characteristics (e.g. azimuth, height, length, asymmetry) of fractures in the target zone of interest in the subterranean formation; and the pumping schedule may be modified based on the monitored parameter. In some embodiments, the microseismic activity may be used to determine fracture space within the fractured zone and correlated to a simulated volume of stimulated fracture space within the fractured zone. This simulated volume may be compared to the volume of treatment fluid pumped into target zone of interest, and the comparison repeated over time as the treatment proceeds. If the simulated volume of void space ceases to increase at a rate analogous to the input volume of treatment fluid, this indicates a decrease in the effectiveness of the treatment. The microseismic activity could also be used to determine when the treatment propagates out of zone or into a water producing zone indicating that continued treatment is not beneficial. Based on this monitored parameter and possible comparisons of the monitored parameter with other information, the pumping rate of the treatment fluid may be changed, or stopped and a diversion agent injected. The coiled tubing string 20 may be used for precise placement of the diversion agent in the wellbore.

As described herein, multiple zones may be controlled based on the monitored parameter(s). The design of individual treatment stages may be optimized based on the monitored parameter(s). For example, various treatment parameters, such as pumping schedule, injection rate, fluid viscosity or proppant loading, can be modified during the treatment to provide optimal and efficient treatment of a target zone.

As a more specific example, assume that target zone 40*a* of FIG. 1 is currently being treated. At the conclusion of the treatment, the coiled tubing string 20 is positioned so that the BHA 30 at the end of the coiled tubing string 20 is placed at a location desired for the pumping of a diversion agent into an interval of the wellbore 12 desired for a diversion. In accordance with some embodiments of the invention, the location for diversion may be the recently treated zone of interest, which in this example is target zone 40*a*.

The diversion of fluid from the wellbore 12 to a subterranean formation or the diversion of a fluid from a subterranean formation to the wellbore is referred to herein as a diversion stage. In some embodiments, the diversion agent may be pumped in the perforations of the casing string 14 to seal the perforations. In some embodiments, the diversion agent may be pumped through the perforations and into the stimulated zone in the subterranean formation. In embodiments performed in open-hole wellbore, the diversion agent may be pumped directly from the coiled tubing through the BHA and into the target zone in the subterranean formation. Alternatively, the diverting agent could also introduced into the annulus formed between the wellbore wall and coiled tubing. The diversion agent is preferable suitable for acting as a diversion agent in the formation or in the perforations. In some embodiments, the diversion agent may be a fluid that contains fiber.

Known methods for including fibers in treatment fluids and suitable fibers are disclosed in U.S. Pat. No. 5,501,275, which is hereby incorporated by reference in its entirety. In some embodiments, the diversion agent may comprise degradable material. Known compositions and methods for using slurry comprising a degradable material for diversion are disclosed in U.S. patent application Ser. No. 11/294,983, published as U.S. Patent Application Publication No. 2006/0113077, which is hereby incorporated by reference in its entirety.

One or more parameters may be monitored in the well 10 to determine or confirm placement of the diversion agent. As permeable areas of the target interval (pore throats, natural and created fractures and vugs, etc.) are plugged by diversion agent, pressure typically increases. So, for example, while pumping the diversion agent, the surface or bottom hole treating pressure may be monitored (via sensors of the BHA 30, for example) for any pressure changes as the diversion agent contacts the formation, as a pressure change may be indicative of placement of the diversion agent. The dissolving capacity of a degradable diversion agent, when used, preferentially is calibrated to the sequencing of treatment stages to provide diversion from the interval into which is has been placed throughout all the treatment stages.

Figure 3:
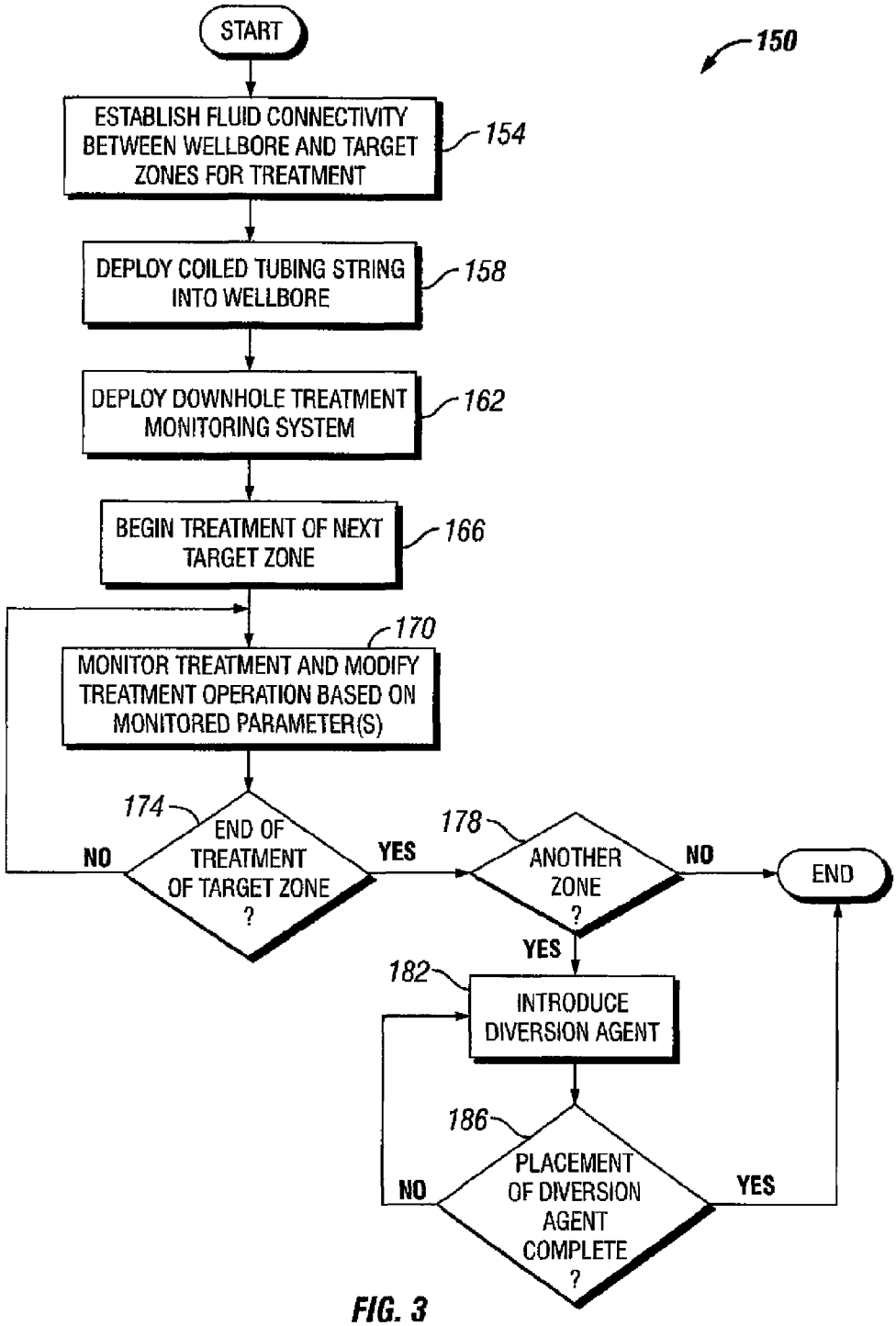

To summarize, referring to FIG. 3, in accordance with embodiments of the invention described herein, a technique 150 may be used to treat multiple target zones of interest. Pursuant to the technique 150, fluid connectivity is established between a wellbore and the target zones for treatment, pursuant to block 154. Next, a coiled tubing string is deployed (block 158) into the wellbore; and subsequently, a downhole treatment monitoring system is deployed into the wellbore 10, pursuant to block 162.

Pursuant to the technique 150, a sequence then begins to treat the zones one at a time. Pursuant to this sequence, the treatment of the next target zone begins, pursuant to block 166. The treatment is monitored and modified based on one or more monitored downhole parameters, pursuant to block 170. The monitoring and modification of treatment continues until it is determined (diamond 174) that the treatment of the current target zone has been completed. Upon this occurrence, a determination is made (diamond 178) whether another target zone of interest is to be treated. If so, then a diversion agent is introduced into a particular interval of the well, pursuant to block 182. For example, in accordance with some embodiments of the invention, the diversion agent may be introduced into the recently treated zone. Once it is determined (diamond 186) that the placement of the diversion agent is complete, then control proceeds to block 166 to being the treatment of the next target zone.

Other embodiments are possible and are within the scope of the appended claims. For example, in accordance with other embodiments of the invention, the treatment and perforation may occur without the use of a coiled tubing string. In this regard, another treatment technique in accordance with embodiments of the invention includes establishing fluid connectivity between a wellbore and target zones for treatment, where the wellbore intersects one or more subterranean formations in which there exists more than one target zone for treatment.

In another embodiment, this technique could be used to stimulate a previously stimulated well. In this case, the treatment may start by first re-stimulating the existing zones, or by first diverting from the existing zones and then perforating new zones for stimulation.

The apparatus or system for measuring or monitoring is then deployed into the well, as described above. In this regard, hydraulic fracture monitoring in an offset well may be used or alternatively, an apparatus or system for measuring or monitoring at least one parameter that is indicative of treatment may be deployed in the wellbore. For example, the measurement or monitoring device may be deployed with the wellbore, such as the one described in U.S. Pat. No. 6,758,271, and U.S. Pat. No. 6,751,556, each of which is hereby incorporated by reference in its entirety. Other measurement or monitoring apparatuses suitable for use in embodiments of the invention include those known for use in determining borehole parameters such as bottom-hole pressure gauges or bottom-hole temperature gauges.

Next, the treatment of a target zone in the subterranean formation begins by pumping treatment fluid into the wellbore. During this treatment, at least one parameter that is indicative of treatment is monitored and the treatment operation is modified based on the monitored parameter(s).

After the treatment of the particular target zone, a diversion agent is pumped into the wellbore and placed at a location desired for diversion. In some embodiments of the invention, the location for diversion is preferentially the treated target zone of interest. The diversion of fluid from the wellbore to a subterranean formation or the diversion of a fluid from a subterranean formation to the wellbore is referred to herein as a diversion stage. In some embodiments, the diversion agent may be pumped in the perforations in casing to seal the perforations. In some embodiments, the diversion agent may be pumped through the perforations and into the stimulated zone in the subterranean formation. In some other embodiments, the diversion agent may be placed in the directly into the wellbore. The diversion agent is preferable suitable for acting as a diversion agent in the formation or in the perforations. In some embodiments, the diversion agent may be a fluid comprising fiber. In some embodiments of the invention, the diversion agent may include degradable material.

The operation to place the diversion agent may then be monitored via the one or more measured parameters to determine or confirm placement of the agent.

In some embodiments of the invention, the measured parameter or parameters may be monitored for one or more of the treated target zones or diversion stage throughout the treatment. Such monitoring is useful in the event that a diversion stage loses performance as it would signal the need for an additional diversion stage or re-injection of additional diverting agent in an existing diversion stage.

In some embodiments of the invention, pumping of treatment fluid is repeated for more than one target zone. In further embodiments of the invention, pumping of a diversion agent is repeated, with the pumping of treatment fluid and the pumping of diversion agent being staged to permit treatment of a target zone followed by subsequent pumping of the diversion agent into the target zone or the perforations adjacent to the target zone to preclude further flow of treatment fluid into the stimulated target zone. For example, in a lateral in a horizontal well, the farthest target zone near the toe of the lateral may be stimulated. Monitoring of a treatment parameter indicative of treatment is used to determine when the treatment stage in the farthest target zone is complete and then a diversion agent placed in that target zone.

A treatment stage may be considered to be when the job design has been completed, when additional fracture development is no longer occurring, when the concentration of proppant in a particular interval is becoming greater than desired, or any other indication that additional treatment of that target zone is no longer desired, efficient, or considered to provide additional benefits. A treatment stage may then be pumped into the next-farthest target zone with the placed diversion agent diverting the treatment fluid away from the farthest target zone and toward the next-farthest target zone. Monitoring of the treatment parameter indicative of treatment is then used to determine when the treatment stage in the next-farthest target zone is completed. A diversion agent is then placed in that next-farthest target zone, thereby diverting the pumped treatment fluid to the next target zone. In this manner, treatment stages may be directed into target zones in a desired sequence, thereby improving the efficiency of the overall treatment by directing the treatment fluid and associated pumping energy into desired intervals.

The techniques that are described herein may be used to control the desired sequence of individual treatment stages. For example, while typically treatment stages would be performed from the bottom of the well toward the surface, it may be desirable in some situations to treat from top to bottom, or to treat from the top to the bottom within a particular one or ones of the subterranean formations. Alternatively it may also be desirable to treat the zones in order from the lowest stress intervals to the highest stress intervals.

Once the treatment stages are completed, it may be desired to remove or eliminate the diversion agent in one or more of the diversion stages. The diversion agent may be removed by such methods of cleanout, such as injecting a fluid (e.g. nitrogen, water, reactive chemical) into the coiled tubing and jetting the fluid through the BHA 30 to erode or loosen the diversion agent from its diverting position in an interval. The fluid, in particular a gas, may be pumped down the coiled tubing 20 at a pressure sufficient to offset the formation pressure on the diversion stage, thereby permitting the diversion agent to move from the interval. In some instances, a slowing activating chemical may be placed in the diversion agent to degrade the diversion agent after an estimated period of time. A breaker, an encapsulated breaker, or a slow release chemical may be useful in this regard.

Alternatively a chemical treatment may be injected into the diversion agent to react with the agent to dissolve, erode, weaken or loosen the diversion agent from its positions. A degradable diversion agent may, by its own degrading nature, cease to divert with time. It is preferable that the diversion agent is effectively removable or eliminable from the interval without leaving residue or residual that may hinder the production of hydrocarbons from the target zone.

In some instances, it may be desirable to leave a diversion stage in place. For example, when a diversion stage is placed in a water-bearing zone, it may be desired to leave that particular diversion stage in place after stimulation is completed while removing diversion stages located in hydrocarbon bearing zone. An advantage of the techniques described herein is that monitoring of a parameter indicative of treatment may provide information as to zones, such as water-bearing zones, for which treatment is not desired. By monitoring the parameter during treatment, the job site operations may be modified to avoid or minimize treatment of undesired zones.

Embodiments of the invention may include establishing fluid connectivity in a cased wellbore by perforating the casing and if present, the cement in the annulus between the casing and the wellbore wall, using a perforating gun deployed on wireline. In this regard, a coiled tubing string that has a BHA with a jetting head may be injected using known equipment and methods to a desired depth in the wellbore. As an alternative to using a perforating gun deployed on wireline, the casing may be perforated as the coiled tubing is run into the wellbore by pumping fluids at pressure through the coiled tubing and out the jetting head to cut openings in the casing and cement.

A system for hydraulic fracture monitoring (HFM) may then deployed and engaged for monitoring. One such commercially available system, StimMAP (a mark of Schlumberger) provides methods for monitoring acoustic signals in an offset well or in the same well resulting from microseisms generated in a treatment well by hydraulic fracturing activity. Hydraulic fracturing fluid that contains proppant may then pumped at pressure into the wellbore and a target zone of interest is fractured. The HFM system is used to monitor the degree and characteristics of the hydraulic fracturing in the target zone of interest in the treatment well. When it is determined using the output of the HFM system that stimulation of the target zone of interest is complete, the hydraulic fracturing operation is modified by stopping or reducing the level of the pressure pumping.

A diversion fluid that contains degradable fibers, or a diversion fluid comprising degradable fibers and particulates, may then pumped down the coiled tubing to the stimulated target zone of interest. Degradable fibers are used in a concentration estimated to provide sufficient structure to permit diversion during hydraulic fracturing activities. The composition of the fibers used provides sufficient longevity of the diversion stages to complete hydraulic fracturing fluid while assuring that in a reasonable time period after fracturing, the diversion stages will self-eliminate through degradation of the structure-providing fiber. The diversion fluid plugs the fractures created in the target zone of interest.

The bottom hole treating pressure within the wellbore is monitored to confirm placement of the diversion agent in the target zone of interest. Hydraulic fracturing fluid may then again pumped at pressure to fracture another target zone of interest, the fluid being diverted away from the already stimulated target zone of interest by the diversion agent. The sequence is repeated for multiple treatment and diversion stages in the wellbore. In this manner, multiple hydrocarbon bearing zones of interest may be stimulated efficiently and production of hydrocarbons may begin from the target zones of interest after stimulation without further intervention to effect stimulated production.

Figure 4A:
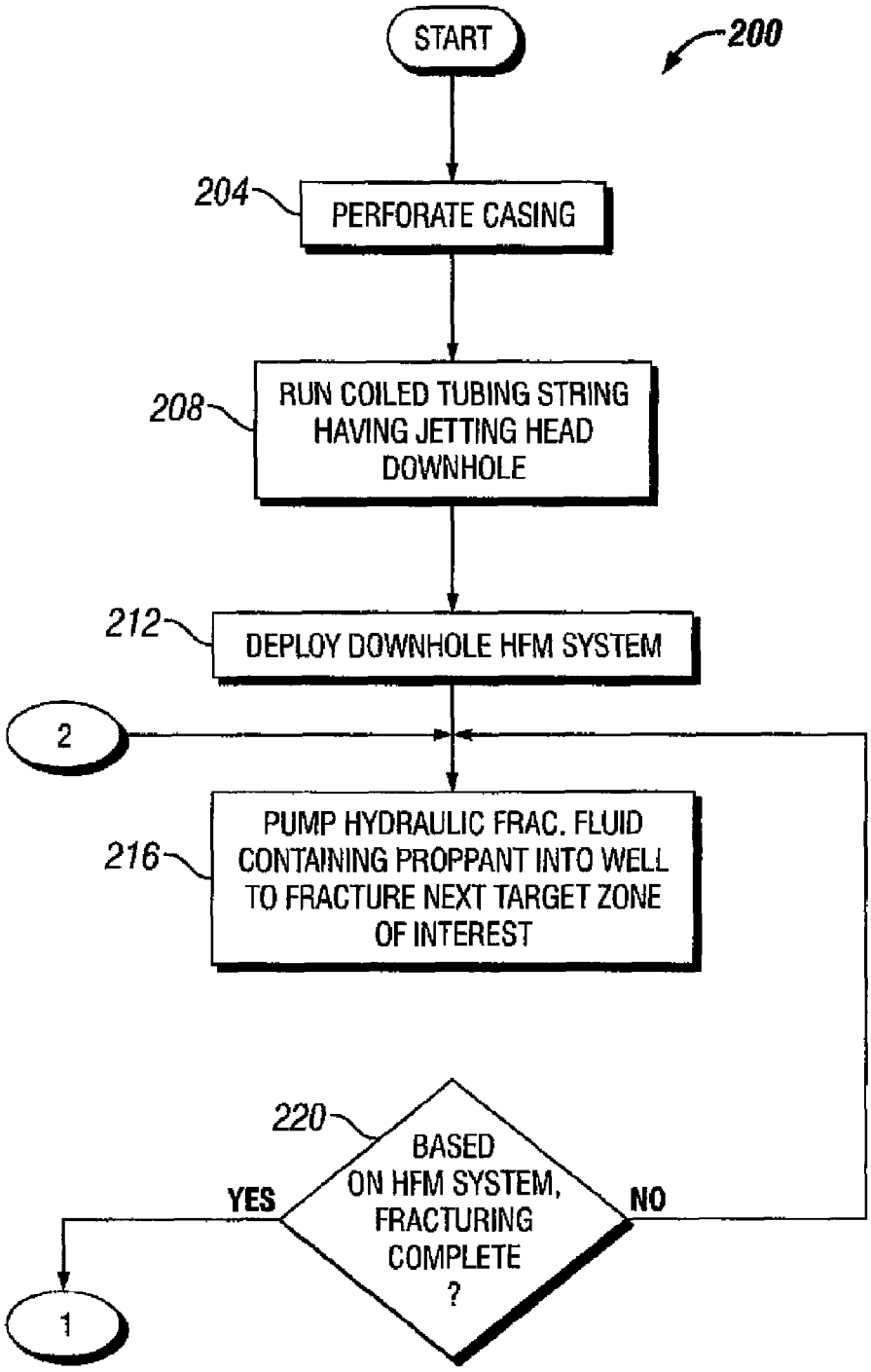
Figure 4B:
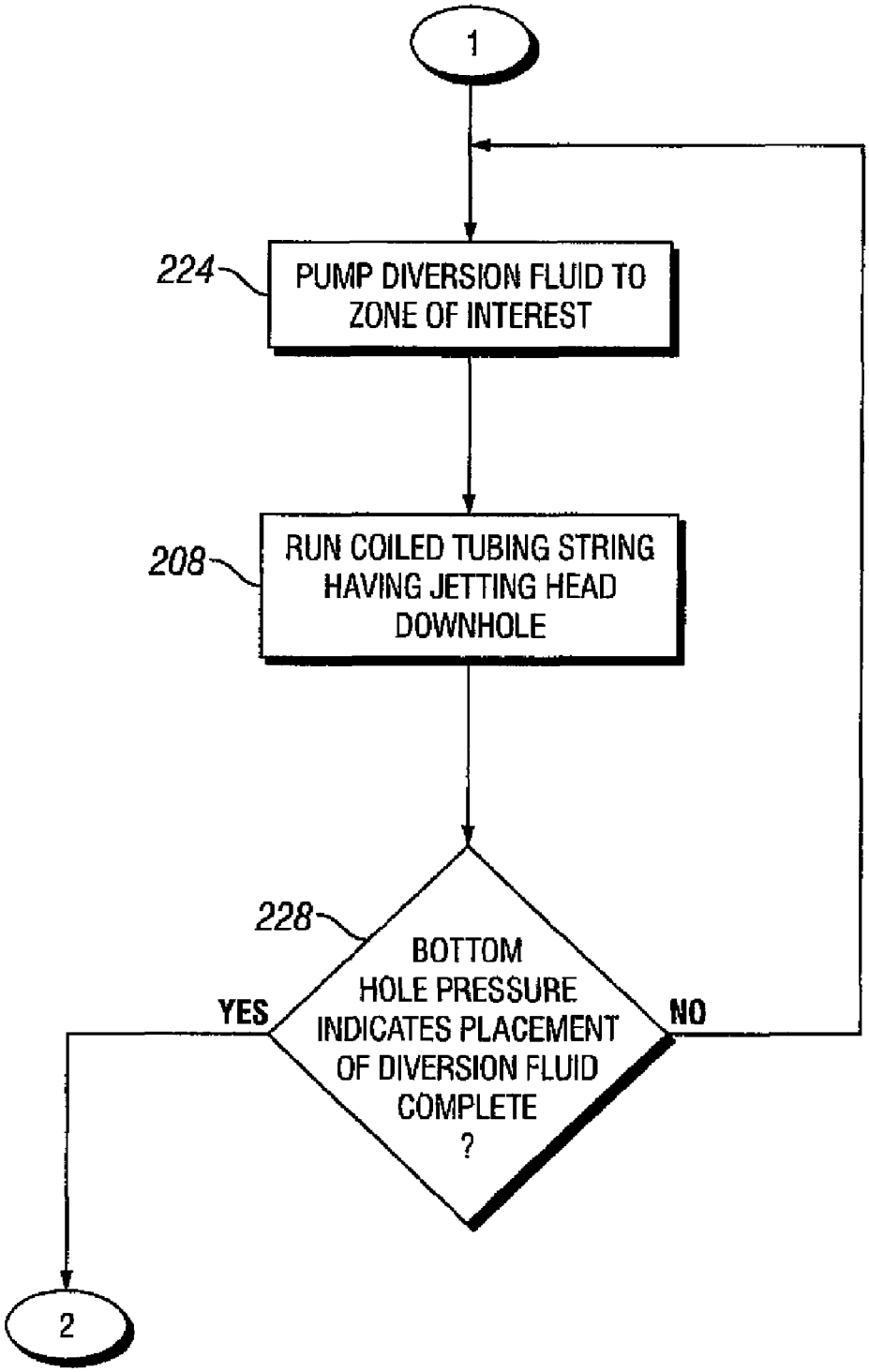

Thus, referring to FIGS. 4A and 4B, a technique 200 may be used in accordance with some embodiments of the invention. Pursuant to the technique 200, a casing of a well is perforated, pursuant to block 204. Next, a coiled tubing string that has a jetting head is run downhole, pursuant to block 208; and a downhole hydraulic fracture monitoring (HFM) system is deployed, pursuant to block 212. The treatment of the target zones then begins by pumping (block 216) hydraulic fracturing fluid containing proppant into the well to fracture the next target zone of interest. Based on the HFM system a determination is made (diamond 220) whether fracturing is complete. If not, the pumping continues, pursuant to block 216.

Next, diversion fluid is pumped (block 224 of FIG. 4B) into the target zone of interest, which was just treated. If a determination is made, pursuant to diamond 228, that the bottom hole pressure indicates completion of the placement of the diversion fluid, then control returns to block 216 for purposes of treating another zone. Otherwise, pumping of the diversion fluid to the recently treated zone of interest continues, pursuant to block 224.

Stimulation treatment in openhole wells presents challenges in that the uniform removal of damages across the whole section is extremely difficult, if not impossible. Damage in the openhole formation normally occurs in the near wellbore region, due to the drilling of the wellbore. Therefore, the total damaged area to be removed typically is more critical than the depth of the penetration by the stimulation fluid.

In accordance with embodiments of the invention disclosed herein, a stimulation treatment is used that combines a mechanical technique for stimulation and a chemical material for zonal coverage. The treatment involves first, the injection of a treatment fluid, such as a "filling fluid" that contains a gel having a suspended fluid loss control agent. The filling fluid may be communicated through a jetting tool at a relatively low rate (as compared to the rate used in connection with jetting) to fill up an entire openhole section. Next, a solid material, such as an abrasive cutting fluid slurry, which contains sand or marble (as examples) is injected into the well by the jetting sub to cut several inches into the formation to bypass the near wellbore damage. The fluid leak off into the formation as a result of the cutting is controlled by the fluid loss control agent of the filling fluid. In general, the filling fluid does not damage to the formation.

Figure 5:
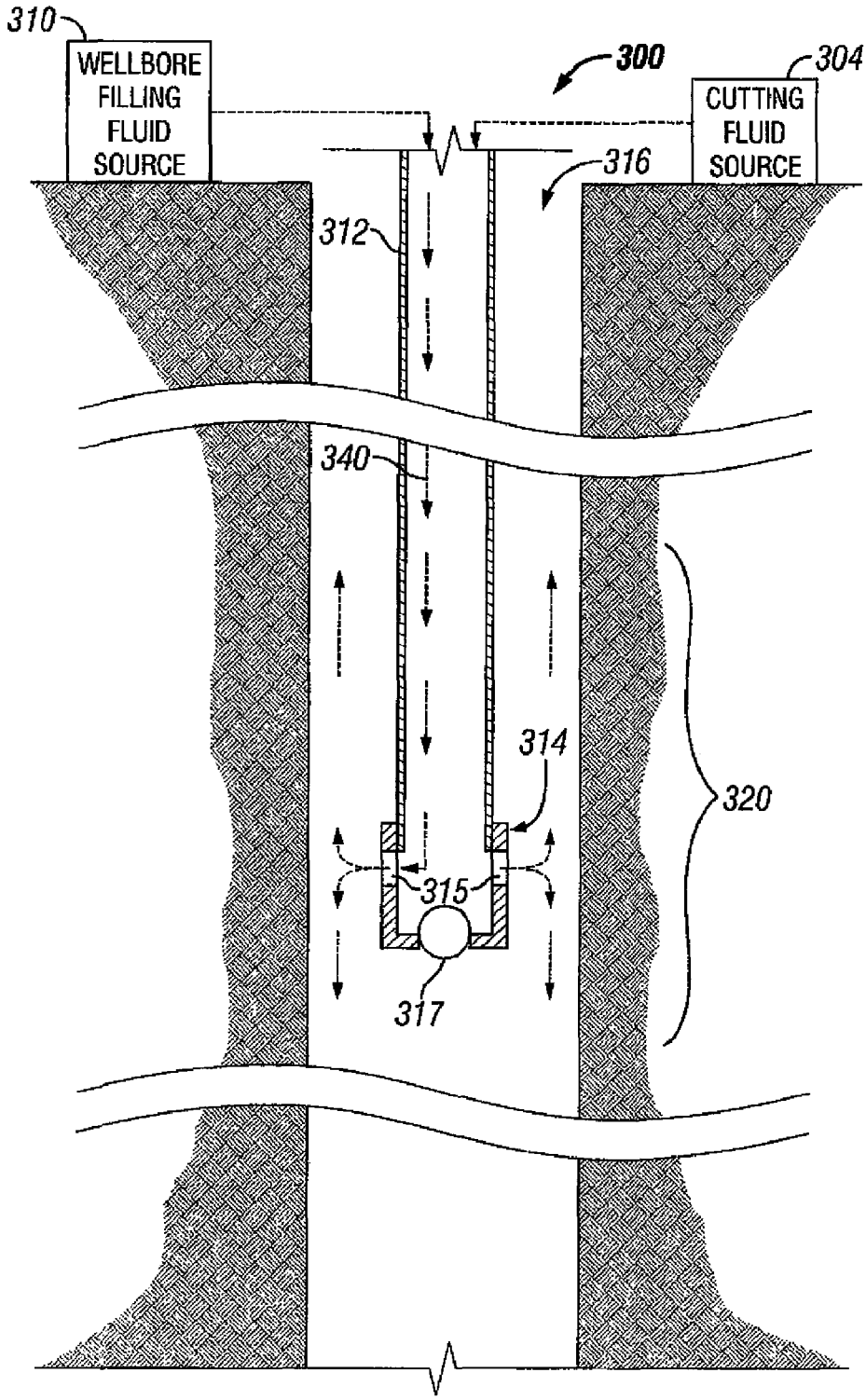

As a more specific example, FIG. 5 depicts a well 300 in accordance with some embodiments of the invention. The well 300 includes a wellbore 316 that intersects an exemplary interval 320. For purposes of treating and jetting the interval 320, a coiled tubing string 312 is deployed in the wellbore 316. The coiled tubing string 312 includes a bottom hole assembly (BHA), which includes a jetting sub 314. It is noted that the jetting sub 314 may be deployed on a jointed tubing string, in accordance with other embodiments of the invention.

As depicted in FIG. 5, the jetting sub 314 may be associated with a reversible check valve, which is activated by deploying a ball 317 through the central passageway of the coiled tubing string 312. In this regard, the ball 317 lodges in a lower port of the coiled tubing string 312 for purposes of directing fluid through radial ports 315 of the jetting tool 314.

Pursuant to the combined stimulation of jetting technique, first, a wellbore filling fluid source 310 communicates the filling fluid (as depicted by flow 340) through the central passageway of the coiled tubing string 312 and via the radial ports 315 into the wellbore interval 320. It is noted that the filling fluid may be made from a gel, made from polymers or VES. Solids or fibrous materials may also be added to the filling material to provide additional leak off control during the subsequent jetting operation.

Figure 6:
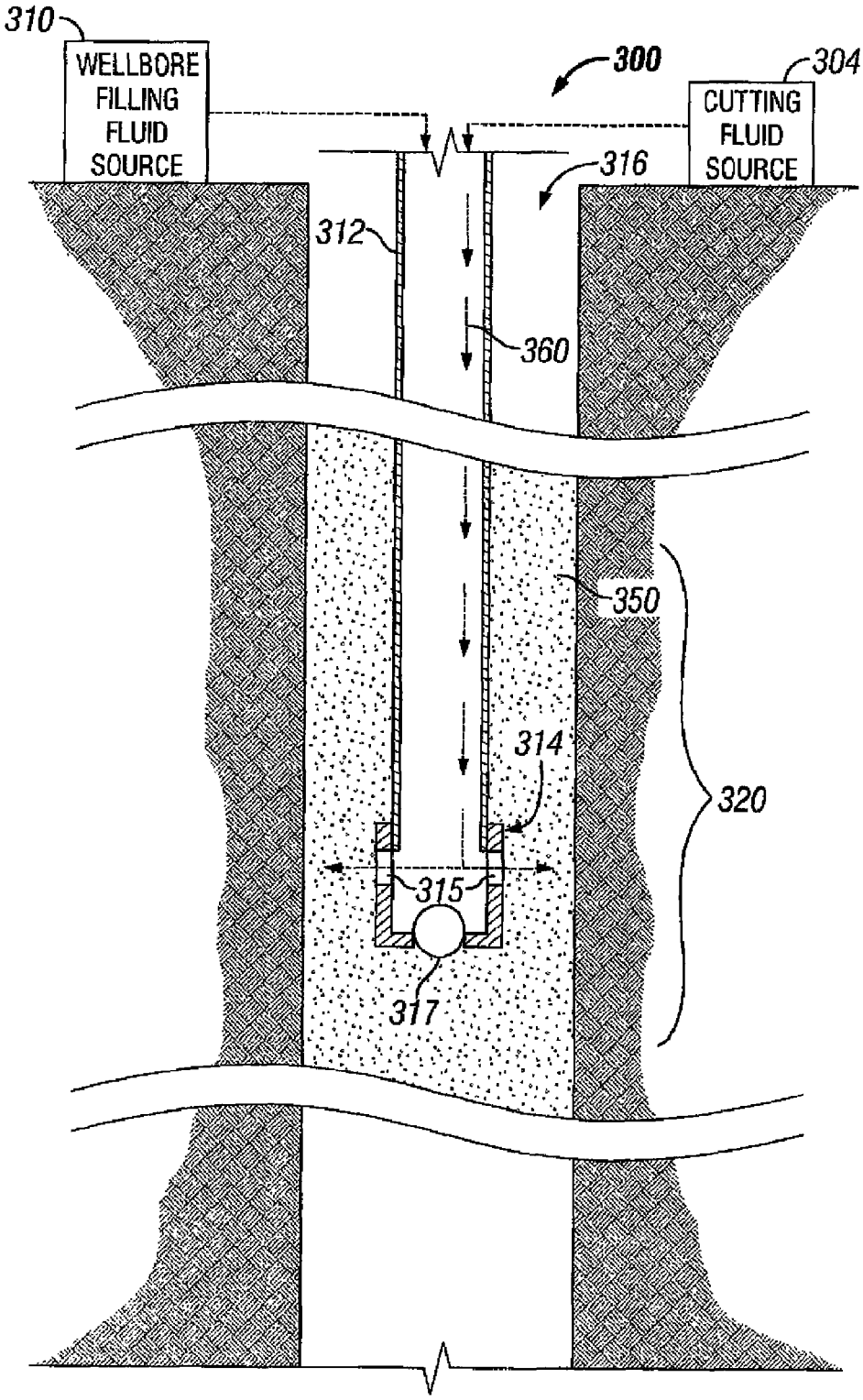

Thus, during the stage depicted in FIG. 5, the filling fluid is communicated into the wellbore interval 320 prior to the second stage, which is depicted in FIG. 6.

Referring to FIG. 6, for this stage of the well 300, the interval 320 is filled by the filling fluid, as depicted at reference numeral 350. With the filling fluid in place inside the interval 320, a cutting fluid source 304 at the surface of the well 300 communicates an abrasive cutting fluid flow, or slurry (as depicted by flow 360), down the central passageway of the coiled tubing string 312 and through the radial ports 315. It is noted that the communication of the abrasive slurry occurs at a much higher pressure than the communication of the fill fluid, for purposes of forming the radial jets to penetrate the surrounding formation past any near wellbore damage.

Depending on the particular formation, the abrasive slurry may be neutral or acidic and may contain a low concentration of sand, proppant or other solid materials.

In accordance with some embodiments of the invention, the filling fluid may be easily removed after the jetting operation or may, alternatively, be self-destructive after the jetting operation, to prevent potential damage to the formation.

Figure 7:
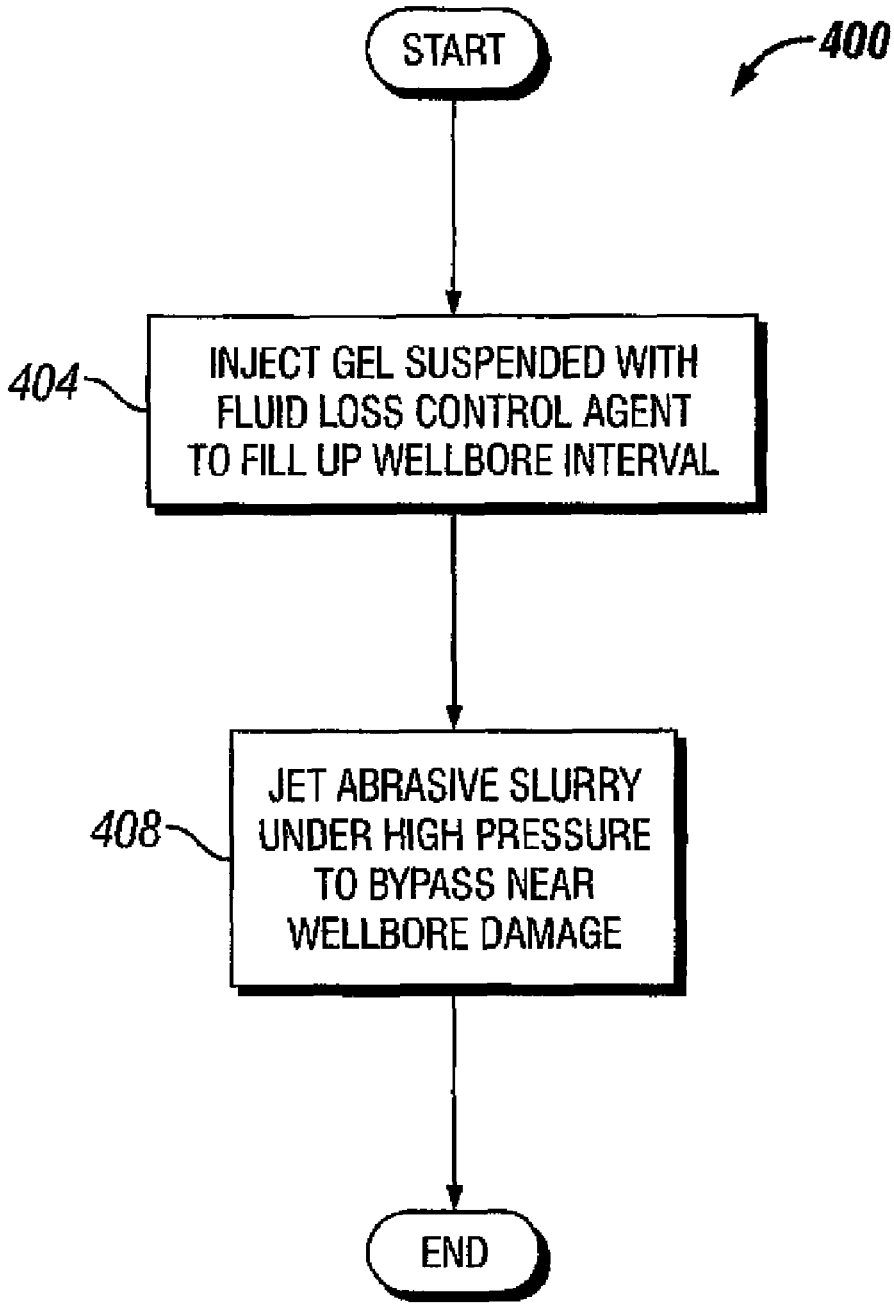
FIG. 7 is a flow diagram depicting a combined stimulation and jetting technique according to an embodiment of the invention.

To summarize, FIG. 7 depicts a combined treatment and jetting technique 400 that may be used in accordance with some embodiments of the invention. Pursuant to the technique 400, a gel suspended with a fluid loss control agent is injected (block 404) to fill up a wellbore interval. Next, pursuant to block 408, an abrasive slurry is jetted under high pressure to bypass near wellbore damage.

The invention may be applied to any type of well, for example cased or open hole; drilled with an oil-based mud or a water-based mud; vertical, deviated or horizontal; with or without sand control, such as with a sand control screen. Although the techniques and systems disclosed herein have been described primarily in terms of stimulation of hydrocarbon producing wells, it is to be understood that the invention may be applied to wells for the production of other materials such as water, helium and carbon dioxide and that the invention may also be applied to stimulation of other types of wells such as injection wells, disposal wells, and storage wells.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method of well treatment, comprising:

a) establishing fluid connectivity between a wellbore and at least two target zones for treatment within a subterranean formation intersected by the wellbore;

b) deploying coiled tubing into the wellbore;

c) introducing a treatment composition into the wellbore;

d) contacting a target zone below at least one target zone within the subterranean formation with the treatment composition;

e) introducing a diversion agent through the coiled tubing to the target zone below at least one target zone; and repeating steps c) through d) for more than one target zone.

2. The method of claim 1, wherein the diversion agent comprises degradable material.

3. The method of claim 1, wherein after contacting the target subterranean formation with the treatment composition, the diversion agent is introduced into the formation.

4. The method of claim 1, further comprising repeating act e).

5. The method of claim 1, further comprising repeating act a) and b) prior to repeating acts c) through d).

6. The method of claim 1, wherein the diversion agent consists of non-degradable material.

7. The method of claim 4, wherein the diversion agent is stored in the coiled tubing between acts of introducing the diversion agent to an interval.

8. A method of treating more than one target zone of interest in a subterranean formation, the method comprising:

a) pumping a treatment composition to contact at least one target zone of interest with the treatment composition;

b) monitoring the pumping of the treatment composition and measuring a parameter indicative of treatment;

c) pumping a diversion agent to a desired diversion interval in the wellbore;

d) monitoring the pumping of the diversion agent and measuring a parameter indicative of diversion wherein measuring comprises measuring microseismic activity;

e) pumping a treatment composition to contact at least one other target zone of interest;

f) modifying at least one of acts a) and c) based on at least one of the measured parameters.

9. The method of claim 8, wherein at least a portion of the wellbore comprises a generally deviated or horizontal section.

10. The method of claim 8, wherein at least one of the diversion interval and the target zone of interest are located within said generally horizontal section.

11. The method of claim 8, further comprising repeating acts a) through d).

12. The method of claim 8, further comprising injecting the treatment composition in the annulus between a coiled tubing and the wellbore.

13. The method of claim 8, wherein the diversion agent comprises a fiber.

14. The method of claim 13, wherein the fiber comprises a degradable material.

15. A method of treating a well, comprising:

a) deploying coiled tubing into a wellbore, wherein connectivity is established by one or more of perforating, jetting, sliding sleeve, or opening a valve, and establishing fluid connectivity between a wellbore and at least one target zone for treatment within a subterranean formation intersected by the wellbore;

b) injecting a treatment composition into the wellbore to contact a hydrocarbon bearing subterranean formation with the treatment composition;

c) providing a diversion agent through the coiled tubing to a desired interval in the wellbore;

d) measuring a wellbore parameter indicative of diversion while performing at least one of act b) or act c) wherein the act of measuring comprises measuring micro seismic activity.

16. The method of claim 15, wherein the treatment composition comprises a fracturing fluid and the measured wellbore parameter is indicative of hydraulic fracturing in the subterranean formation.

17. The method of claim 15, further comprising performing the act of at least one of measuring in an offset well or monitoring a well.

18. The method of claim 15, wherein the act of measuring comprises measuring microseismic activity.

19. The method of claim 18, further comprising determining hydraulic fracture geometry based at least in part on the measurement of microseismic activity.

20. The method of claim 15, further comprising modifying at least one of the act of providing a diversion and the act of injecting a treatment composition based on the measured wellbore parameter.

21. A method of treating a well, comprising:

a) measuring a wellbore parameter indicative of diversion to establish a baseline;

b) providing a diversion agent through the coiled tubing to a desired interval in the wellbore;

c) injecting a treatment composition into the wellbore to contact a target zone in a subterranean formation with the treatment composition; and d) measuring the wellbore parameter while performing at least one of act b) and act c) wherein the act of measuring comprises measuring microseismic activity.

22. The method of claim 21, further comprising, prior to performing act b), establishing fluid connectivity between a wellbore and at least one target zone for treatment within a subterranean formation intersected by the wellbore.

23. The method of claim 21, further comprising measuring the wellbore parameter continuously throughout the acts of providing the diversion agent and injecting a treatment composition.

24. The method of claim 21, further comprising modifying the baseline measured wellbore parameter to the wellbore parameter measured in act d).

25. The method of claim 21, further comprising modifying the method of treatment is modified based on the wellbore parameter measurement of act d).

26. A method of well treatment, comprising:

a) establishing fluid connectivity between a wellbore and at least one target zone for treatment within a subterranean formation intersected by the wellbore;

b) deploying coiled tubing into the wellbore;

c) introducing a treatment composition into the wellbore;

d) contacting a target zone within the subterranean formation with the treatment composition;

e) introducing a diversion agent through an annulus formed between the wellbore and the coiled tubing to an interval within the wellbore wherein measuring comprises measuring microseismic activity; and repeating steps c) through e) for more than one target zone.

27. A system usable with a well, comprising:

a tubing string;

a treatment fluid source to communicate a treatment composition in the well to contact a hydrocarbon bearing subterranean formation with the treatment composition;

a diversion agent source to communicate a diversion agent through the tubing string into an interval of the well and microseismic equipment to measure a wellbore parameter indicative of diversion.

28. The system of claim 27, wherein the diversion agent source communicates the diversion agent through the tubing string for additional intervals of the well.

29. The system of claim 27, wherein the diversion agent isolates a region of the well where the treatment composition contacted the formation.

30. The system of claim 27, further comprising:

a monitoring subsystem located in the well to monitor at least one parameter associated with the communication of the treatment composition, wherein the treatment fluid source is controlled based on said at least one parameter.

31. The system of claim 27, further comprising:

a monitoring subsystem located in the well to monitor at least one parameter associated with the communication of the diversion agent, wherein the diversion agent source is controlled based on said at least one parameter.

32. A method usable with a well, comprising:

introducing a fluid containing a fluid loss control agent in an interval of the well; and subsequent to the introduction of the fluid and in the presence of the fluid, jetting a slurry into a formation in the interval to bypass near wellbore damage in the formation.

33. The method of claim 32, wherein the fluid comprises a gelling agent.

34. The method of claim 33, wherein the gelling agent comprises at least one of a polymer and VES.

35. The method of claim 34, wherein the VES is degradable.

36. The method of claim 32, wherein the fluid comprises at least one of a solid material and a fibrous material.

37. The method of claim 32, wherein the slurry comprises a solid and the solid comprises at least one of sand and proppant.

38. The method of claim 32, wherein the slurry comprises an acid.

39. The method of claim 32, wherein the interval comprises an openhole interval.

40. The method of claim 32, further comprising:

completing the interval with a slotted liner.

41. The method of claim 32, wherein the interval comprises one of the following: a carbonate formation and a sandstone formation, a shale formation, or a coal formation.

42. A system usable with a well, comprising:

a jetting sub deployed downhole in the well;

a first source to supply a fluid containing a gelling agent in an interval of the well; and a second source to, subsequent to the introduction of the fluid and in the presence of the fluid, supply a slurry to cause the jetting sub to produce jets to bypass near wellbore damage in the formation.

43. The system of claim 42, wherein the slurry comprises an acid.

44. The system of claim 42, wherein the slurry comprises a solid comprising at least one of sand and proppant.

* * * * *